US006719479B1

(12) United States Patent
Marsh et al.

(10) Patent No.: US 6,719,479 B1
(45) Date of Patent: Apr. 13, 2004

(54) BREECH LOCK WIRELINE CONNECTOR

(75) Inventors: Brent Marsh, Dorset (GB); Robert Parker, Dorset (GB)

(73) Assignee: Tuboscope I/P, Inc., Houston, TX (US)

( * ) Notice: Subject to any disclaimer, the term of this patent is extended or adjusted under 35 U.S.C. 154(b) by 472 days.

(21) Appl. No.: 09/730,544

(22) Filed: Dec. 7, 2000

(51) Int. Cl.[7] ..... B25G 3/18; F16B 21/00; F16D 1/00

(52) U.S. Cl. ..... 403/327; 166/242.6; 403/348; 403/325; 403/323

(58) Field of Search ..... 403/348, 349, 403/350–52, 321, 322.1, 323, 325, 327, 303; 175/322; 166/242.6, 242.7

(56) References Cited

U.S. PATENT DOCUMENTS

| | | | | | |
|---|---|---|---|---|---|
| 805,674 | A | * | 11/1905 | Senderling | |
| 3,275,354 | A | | 9/1966 | Sutliff et al. | |
| 3,540,087 | A | * | 11/1970 | Marosy | 24/211 |
| 3,998,560 | A | * | 12/1976 | Damour | 403/26 |
| 4,364,155 | A | * | 12/1982 | Synowicki | 24/217 |
| 4,784,543 | A | * | 11/1988 | Mitchell et al. | 409/234 |
| 4,986,690 | A | * | 1/1991 | Cooksey | 403/319 |
| 5,088,853 | A | * | 2/1992 | Reid | 403/330 |
| 5,607,250 | A | * | 3/1997 | Tatterson et al. | 403/325 |
| 6,126,359 | A | * | 10/2000 | Dittrich et al. | 403/349 |

FOREIGN PATENT DOCUMENTS

| | | |
|---|---|---|
| EP | 0 263 671 B1 | 4/1988 |
| GB | 2314391 | 12/1997 |

* cited by examiner

*Primary Examiner*—Anthony Knight
*Assistant Examiner*—Michael J. Kyle
(74) *Attorney, Agent, or Firm*—Finnegan, Henderson, Farabow, Garrett & Dunner LLP

(57) ABSTRACT

A breech lock wireline connector for connecting tools to a wireline inserted into a well bore. The connector has a housing with an axially movable plunger within the housing and each being in axial alignment. A spring is used for biasing the plunger axially toward and into engagement with the breech pin. The breech pin is selectively engageable and disengageable into lock and unlock positions, respectively, with the plunger and the housing. The plunger rotates the breech pin axially between the lock and unlock positions. A latch is provided for latching the plunger and breech pin in the lock position.

4 Claims, 3 Drawing Sheets

BREECH LOCK WIRELINE CONNECTOR

BACKGROUND OF THE INVENTION

The present invention relates to a wireline toolstring connector for connecting a number of tools together when they are inserted into a well bore.

In oil drilling and other well operations, a wireline is used for raising and lowering tools into the well bore. Specifically, this is achieved by attaching a toolstring to the end of a reel of a single strand or braided wire. By reeling out the wire, the toolstring may be lowered to the desired location within the well. Various tools for gathering data and the like may be attached together to form a toolstring for placement within the well bore.

In applications of this type, the connector at each end of the wireline tool, which form the toolstring to be placed within the well bore, is subject to tension, compression and torque forces within the well, and thus must be of a construction that will not disconnect from each other under these conditions. In addition, however, it is desirable to have a connector that may readily disconnect from each other upon removal thereof from the well bore for reuse.

The present invention provides a wireline tool connector that achieves both of these objects in providing resistance to separating forces in combination with ease of manual disconnection upon removal of the connector from the well bore to permit it to be reused in a subsequent application.

SUMMARY OF THE INVENTION

The invention relates to a breech lock wireline toolstring connector for connecting tools to a wireline inserted into a well bore. The connector has a housing with an axially movable plunger and an axially movable breech pin in the housing and in axial alignment. Spring means are used for biasing the plunger axially toward and into engagement with the breech pin. The breech pin has means for selectively engaging and disengaging into lock and unlock positions, respectively, with the plunger and with the housing. Means are provided on the breech pin for rotating the plunger axially between the lock and unlock positions. Further provided, are latching means for latching the plunger and breech pin in the lock position.

The means for rotating the breech may include a tang on the plunger adapted for selective engagement in the slot in the breech pin.

The latching means may include a slot in the plunger adapted to engage a pin upon rotation of the breech pin to the lock position.

The latching means may further include detent means between the housing and the plunger.

DETAILED DESCRIPTION OF THE PREFERRED EMBODIMENTS

Figure 1:
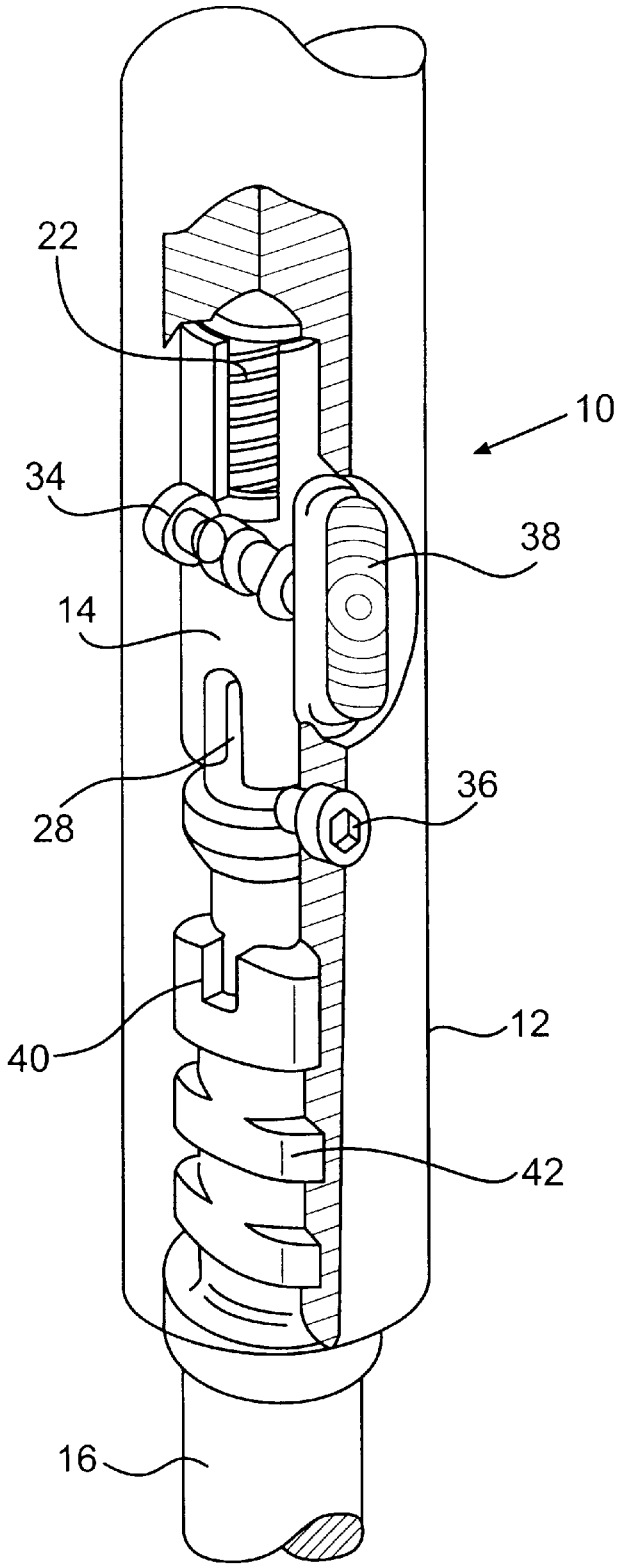
FIG. 1 is a perspective view of the connector.
Figure 2:
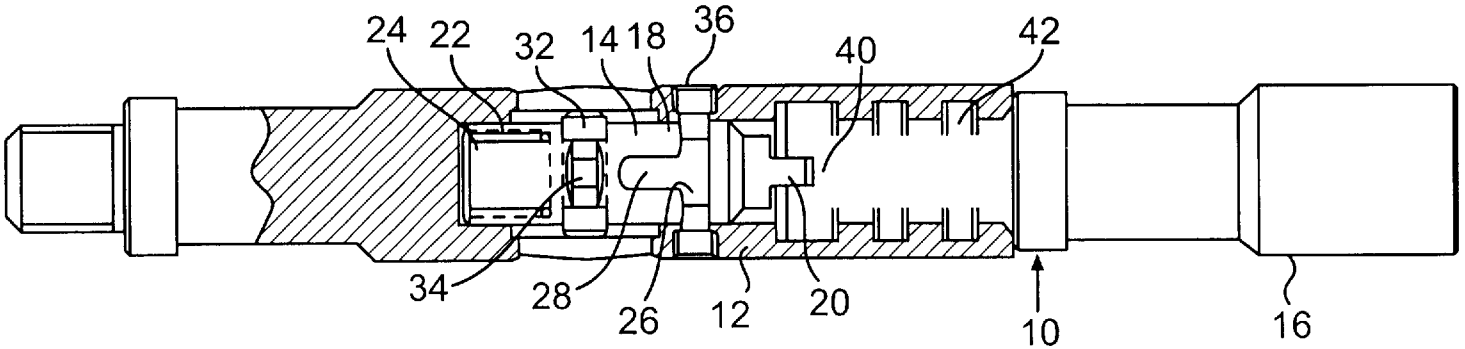
FIG. 2 is an assembly view of the connector in vertical cross-section

With reference to the figures, the connector is designated as 10 and includes a housing 12. Within the housing 12 is a plunger 14 and a breech pin 16.

The plunger 14 has a body portion 18 having at one end a tang 20 and at an opposite end a recess 24 housing spring 22 that biases the plunger 14 into engagement with breech pin 16. The body portion 18 further includes an annular groove 26 from which extends a longitudinal recess 28. Also, transverse through bore 30 is provided in the body portion 18 which houses spring loaded locking inserts 32 and associated spring 34.

Pins 36 extend through the housing 12 into contact with annular groove 26 and longitudinal recess 28.

Pawls 38 are retained in opposite sides of the housing 12 and engage locking inserts 32.

The breech pin 16 has a slot 40 in one end thereof and adapted to engage tang 20. Rearward of slot 40 are a series of arc-shaped projections 42. The housing 12 has a like number of recesses 44 adapted to receive projections 42.

Figure 3:
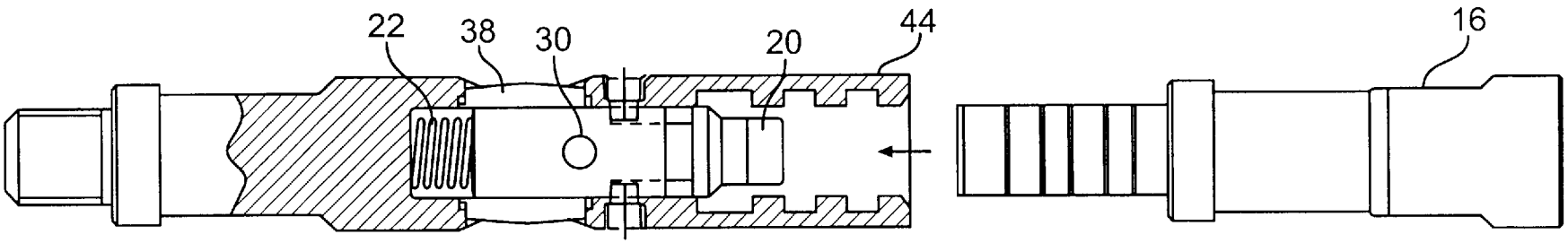
FIG. 3 is a view similar to FIG. 2 with the connector unconnected.
Figure 4:
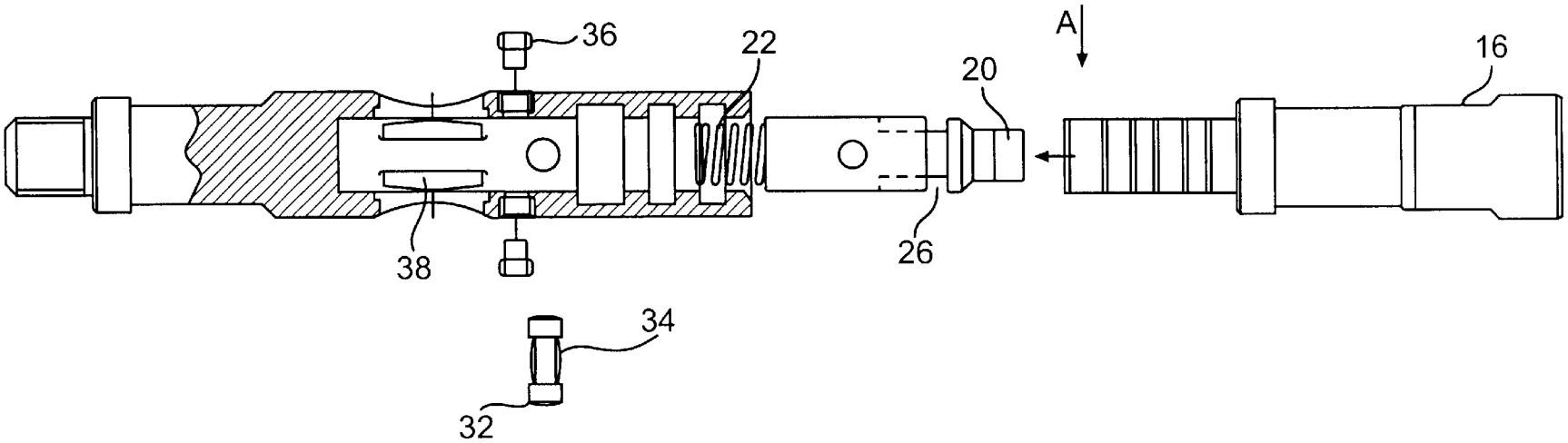
FIG. 4 is an exploded view of the connector as shown in FIG. 3.
Figure 5:
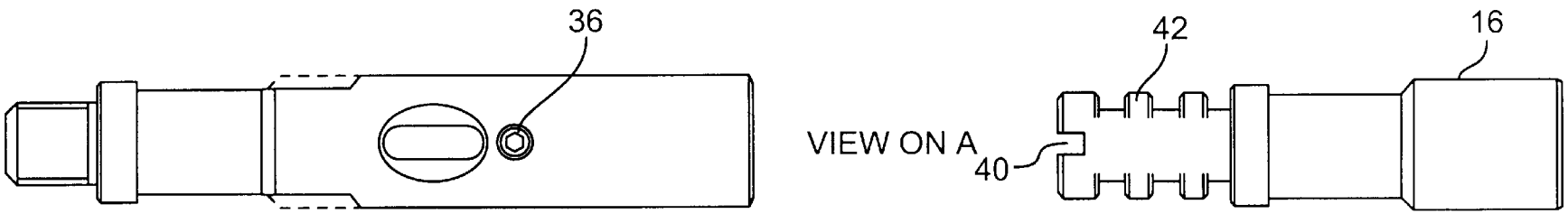
FIG. 5 is an elevation view of the connector unconnected.

In the operation of the connector 10 with the components thereof being as shown in FIG. 3 in the unconnected position, breech pin 16 is moved axially into the housing 12 to bring tang 20 of the plunger 14 into contact with recess 40 of the breech pin. As the breech pin is advanced, spring 22 is compressed and pins 36 travel in the longitudinal slot 28 of the plunger. With the spring fully compressed, the breech pin is rotated one quarter turn in either direction which likewise rotates the plunger 14 because of the engagement of the tang 20 in the recess 40 of the breech pin 16.

Resulting from this one quarter rotation, the projections 42 on pin 16 come into engagement with recesses 44 of housing 12. Also, the screws 36 slide out of the longitudinal slot 28 and of housing 12 and rotate in the annular groove 26. In this position, the plunger 14 is secured against longitudinal movement. In addition, the spring loaded locking inserts 32 are moved radially by spring 34 to engage the housing and thereby prevent annular movement of the plunger 14 and associated breech pin by this detent mechanism. These inserts in this position now locate behind pawls 38. This then is the position of the components of the connector in the connection state.

To place the connector in the unconnected state, the pawls are each manually depressed to compress spring 34 and allow locking inserts 32 to disengage from housing 12. This, in turn, allows the breech pin 16 to rotate to bring the projections 42 of the breech pin out of contact with the recesses 44. This further allows the tang 20 of the plunger to likewise rotate to bring the pins screws 36 back into the longitudinal slot 28. This allows spring 22 to expand, and with the projections 42 being out of contact with slots 44, this action of spring 22 moves the breech pin 16 longitudinally out of the housing 12.

What is claimed is:

1. A breech lock wireline connector for connecting wireline operated toolstrings inserted into a well bore, comprising:

a housing;

an axially movable plunger within said housing;

an axially movable breech pin within said housing in axially alignment with said plunger;

spring means for biasing said plunger axially toward and into engagement with said breech pin;

said breech pin having means for selectively engaging and disengaging into lock and unlock positions, respectively, with said plunger and with said housing;

means on said breech pin for rotating said plunger axially between said lock and unlock positions; and latching means for latching said plunger and breech pin in said lock position.

2. The connector of claim 1, wherein said means for rotating said plunger includes a tang on said plunger adapted for selective engagement in a slot in said breech pin.

3. The connector of claim 2, wherein said latching means includes a slot in said plunger adapted to engage a pin upon rotation of said breech pin to said lock position.

4. The connector of claim 3, wherein said latching means further includes detent means between said housing and said plunger.

* * * * *